US009711860B2

(12) United States Patent
Ying et al.

(10) Patent No.: US 9,711,860 B2
(45) Date of Patent: Jul. 18, 2017

(54) WIDEBAND ANTENNAS INCLUDING A SUBSTRATE INTEGRATED WAVEGUIDE

(71) Applicant: Sony Mobile Communications Inc., Lund (SE)

(72) Inventors: Zhinong Ying, Lund (SE); Kun Zhao, Stockholm (SE)

(73) Assignees: Sony Corporation, Tokyo (JP); Sony Mobile Communications Inc., Tokyo (JP)

( * ) Notice: Subject to any disclaimer, the term of this patent is extended or adjusted under 35 U.S.C. 154(b) by 28 days.

(21) Appl. No.: 14/825,199

(22) Filed: Aug. 13, 2015

(65) Prior Publication Data

US 2017/0047658 A1 Feb. 16, 2017

(51) Int. Cl.

| | |
|---|---|
| ***H01Q 13/00*** | (2006.01) |
| ***H01Q 1/52*** | (2006.01) |
| ***H01Q 13/02*** | (2006.01) |
| ***H01Q 13/18*** | (2006.01) |

(52) U.S. Cl.

CPC ..... *H01Q 13/00* (2013.01); *H01Q 1/521* (2013.01); *H01Q 13/0225* (2013.01); *H01Q 13/18* (2013.01)

(58) Field of Classification Search

CPC ..... H01Q 13/00; H01Q 1/32; H01Q 13/02; H01Q 1/52; H01Q 13/18

USPC ..... 343/780

See application file for complete search history.

(56) References Cited

U.S. PATENT DOCUMENTS

| | | | | |
|---|---|---|---|---|
| 6,850,205 | B2 * | 2/2005 | Yamamoto | H01Q 13/02 343/772 |
| 7,518,566 | B2 * | 4/2009 | Schoebel | H01Q 1/3233 343/754 |
| 7,724,197 | B1 * | 5/2010 | Hardie | H01Q 3/40 343/754 |
| 7,847,749 | B2 * | 12/2010 | Haziza | H01Q 1/32 343/772 |
| 8,743,004 | B2 * | 6/2014 | Haziza | H01Q 13/0233 343/772 |
| 2004/0061657 | A1 | 4/2004 | Yamamoto et al. | |

(Continued)

FOREIGN PATENT DOCUMENTS

| | | |
|---|---|---|
| CN | 104 752 836 A | 7/2015 |
| EP | 1 768 211 A1 | 3/2007 |

OTHER PUBLICATIONS

International Search Report and Written Opinion Corresponding to International Application No. PCT/JP2016/000703; Date of Mailing: May 10, 2016; 11 Pages.

*Primary Examiner* — Huedung Mancuso
(74) *Attorney, Agent, or Firm* — Myers Bigel, P.A.

(57) ABSTRACT

A wireless electronic device includes a Substrate Integrated Waveguide (SIW), a first metal layer including one or more top wave traps, a second metal layer, a feeding structure extending through the first metal layer and into the SIW, and a reflector on the first side of the SIW. The reflector directly connects to the first metal layer and extends outward along a major plane of the first side of the first metal layer. The wireless electronic device is configured to resonate at a resonant frequency when excited by a signal transmitted or received though the feeding structure. The one or more top wave traps are configured to trap a signal radiated by the reflector based on the signal transmitted or received though the feeding structure.

21 Claims, 18 Drawing Sheets

(56) References Cited

U.S. PATENT DOCUMENTS

2014/0320364 A1 10/2014 Gu et al.
2016/0043455 A1* 2/2016 Seler ..... H01P 11/002
333/26

* cited by examiner

WIDEBAND ANTENNAS INCLUDING A SUBSTRATE INTEGRATED WAVEGUIDE

TECHNICAL FIELD

The present inventive concepts generally relate to the field of wireless communications and, more specifically, to antennas for wireless communication devices.

BACKGROUND

Wireless communication devices such as cell phones and other user equipments may include antennas for communication with external devices. These antennas may produce broad radiation patterns. Some antenna designs, however, may facilitate irregular radiation patterns whose main beam is directional.

SUMMARY

Various embodiments of the present inventive concepts include a wireless electronic device including a Substrate Integrated Waveguide (SIW). A first metal layer may be on a first side of the SIW. The first metal layer may include one or more top wave traps, each directly connected to the first metal layer and extending outward along a major plane of a first side of the first metal layer. A second metal layer may be on a second side of the SIW, opposite the first side of the SIW. A feeding structure may extend through the first metal layer and into the SIW. A reflector may be on the first side of the SIW, and the reflector may be directly connected to the first metal layer and extend outward along a major plane of the first side of the first metal layer. In some embodiments, the wireless electronic device may be configured to resonate at a resonant frequency when excited by a signal transmitted or received though the feeding structure. The one or more top wave traps may be configured to shape a signal radiated by the reflector based on the signal transmitted or received though the feeding structure.

According to some embodiments, the second metal layer may include one or more bottom wave traps, each directly connected to the second metal layer and extending outward along a major plane of a first side of the second metal layer. The one or more bottom wave traps may be vertically aligned with respective ones of the top wave traps. In some embodiments, the feeding structure may include a feed via, a ring structure spaced apart from and surrounding the feed via, and/or an insulator between the ring structure and the feed via. A radius of the ring structure and/or a width of the ring structure may be configured to impedance match a signal feeding element that is electrically coupled to the feeding structure. In some embodiments, the feeding structure may extend from the first metal layer through the SIW to the second metal layer.

According to some embodiments, the one or more top wave traps may include a first top wave trap on a first side of the feeding structure, and/or a second top wave trap on a second side of the feeding structure that is opposite the first side of the feeding structure. The first top wave trap and the second top wave trap may be equally distant from the feeding structure. The first top wave trap, the second top wave trap and the reflector may be approximately parallel to one another along a major plane of the first side of the SIW. The reflector may be spaced apart from and equally distant from the first top wave trap and the second top wave trap.

The first top wave trap and the second top wave trap may be directly connected to the first metal layer and may not overlap the SIW.

According to some embodiments, the first metal layer may include a plurality of top via holes spaced apart along the first metal layer overlapping the SIW. The second metal layer may include a plurality of bottom via holes that are approximately vertically aligned with respective ones of the plurality of top via holes. In some embodiments, the feeding structure may be between at least two of the plurality of top via holes in the first metal layer.

According to some embodiments, a first top wave trap of the one or more top wave traps may include a notch in the first metal layer. A first portion of the first top wave trap on one side of the notch may be parallel to and spaced apart from a second portion of the first top wave trap on another side of the notch. The first top wave trap and the second top wave trap may be equally distant from the feeding structure. The first portion of the first top wave trap and/or the second portion of the first top wave trap may extend equally distant away from the SIW. In some embodiments, a length of the first portion of the first top wave trap extending away from the SIW may be between 0.25 effective wavelengths and 0.5 effective wavelengths of the resonant frequency. A length of the second portion of the first top wave trap extending away from the SIW may be between 0.25 effective wavelengths and 0.5 effective wavelengths of the resonant frequency. In some embodiments, a length of the reflector extending away from the SIW may be between 0.25 effective wavelengths and 0.5 effective wavelengths of the resonant frequency.

According to some embodiments, the wireless electronic device may include one or more additional SIW, and/or one or more additional feeding structures extending through the first metal layer. The one or more additional feeding structures may be associated with respective ones of the additional SIWs. The wireless electronic device may include one or more additional reflectors on the first side or the second side of the SIW. The one or more additional reflectors may be associated with respective ones of the additional SIWs and extend outward along a major plane of the first side of the first metal layer or along a major plane of a first side of the second metal layer. In some embodiments, one of the additional reflectors associated with one of the additional SIWs that is adjacent to the SIW may be on the second metal layer and/or may extend outward along a major plane of a first side of the second metal layer.

Various embodiments of the present inventive concepts may include a wireless electronic device including a plurality of Substrate Integrated Waveguides (SIWs) spaced apart of one another and arranged in a plane and/or a first metal layer on a first side of the SIWs. The first metal layer may include a plurality of top wave traps. The plurality of top wave traps may each be directly connected to the first metal layer and/or may extend outward along a major plane of a first side of the first metal layer. A second metal layer may be on a second side of the SIWs, opposite the first side of the SIWs. The second metal layer may include a plurality of bottom wave traps. The plurality of bottom wave traps may each be directly connected to the second metal layer and/or may extend outward along a major plane of a first side of the second metal layer. The wireless electronic device may include a plurality of feeding structures associated with respective ones of the SIWs. The plurality of feeding structures may extend through the first metal layer and into the associated SIW. The wireless electronic device may include a plurality of reflectors directly connected to and/or extending outward along the major plane of either the first metal layer or the second metal layer. Respective ones of the plurality of reflectors may be associated with respective ones of the SIWs. In some embodiments, a first reflector of the plurality of reflectors may be associated with a first SIW of the plurality of the SIWs and/or may extend outward along the first side of the first metal layer. A second reflector of the plurality of reflectors may be associated with a second SIW of the plurality of SIWs that is adjacent the first SIW, and/or may extend outward along the first side of the second metal layer. The wireless electronic device may be configured to resonate at a resonant frequency when excited by a signal transmitted or received though at least one of the feeding structures. The first top wave trap and the second top wave trap of the plurality of top wave traps may each be adjacent the first reflector and may be configured to trap a signal radiated by the reflector based on the signal transmitted or received though the at least one of the feeding structures and may be radiated by the first reflector.

According to some embodiments, the first reflector may be approximately parallel to the first top wave trap and the second top wave trap. The first reflector may extend between the first top wave trap and the second top wave trap. The second reflector may be approximately parallel to a first bottom wave trap and a second bottom wave trap of the plurality of bottom wave traps. The second reflector may extend between the first bottom wave trap and the second bottom wave trap. In some embodiments, the second top wave trap may vertically align with the first bottom wave trap. The plurality of top wave traps may include a third top wave trap that vertically aligns with the second bottom wave trap. The plurality of bottom wave traps may include a third bottom wave trap that may vertically align with the first top wave trap.

According to some embodiments, the wireless electronic device may include a first subarray including a first plurality of the SIWs and/or a second subarray comprising a second plurality of the SIW. The first subarray and/or the second subarray may be configured to transmit multiple-input and multiple-output (MIMO) communication and/or diversity communication.

Other devices and/or operations according to embodiments of the inventive concepts will be or become apparent to one with skill in the art upon review of the following drawings and detailed description. It is intended that all such additional devices and/or operations be included within this description, be within the scope of the present inventive concepts, and be protected by the accompanying claims. Moreover, it is intended that all embodiments disclosed herein can be implemented separately or combined in any way and/or combination.

BRIEF DESCRIPTION OF THE DRAWINGS

The accompanying drawings, which are included to provide a further understanding of the present disclosure and are incorporated in and constitute a part of this application, illustrate certain embodiment(s). In the drawings.

DETAILED DESCRIPTION

The present inventive concepts now will be described more fully with reference to the accompanying drawings, in which embodiments of the inventive concepts are shown. However, the present application should not be construed as limited to the embodiments set forth herein. Rather, these embodiments are provided so that this disclosure will be thorough and complete, and to fully convey the scope of the embodiments to those skilled in the art. Like reference numbers refer to like elements throughout.

Various wireless communication applications may use patch antennas, dielectric resonator antennas (DRAs) and/or Substrate Integrated Waveguide (SIW) antennas. Patch antennas and/or Substrate Integrated Waveguide (SIW) antennas may be suitable for use in the millimeter band radio frequencies in the electromagnetic spectrum from 10 GHz to 300 GHz. Patch antennas and/or SIW antennas may each provide radiation beams that are quite broad. A potential disadvantage of patch antenna designs and/or SIW antenna designs may be that the radiation pattern is directional. For example, if a patch antenna is used in a mobile device, the radiation pattern may only cover half the three dimensional space around the mobile device. In this case, the antenna produces a radiation pattern that is directional, and may require the mobile device to be directed towards the base station for adequate operation.

Various embodiments described herein may arise from the recognition that the SIW antenna designs may be improved by adding other elements such as a reflector that improves the radiating of the antenna and wave traps that control and/or reduce mutual interference of the signals from the reflector. The reflector and/or wave trap elements may improve the antenna performance by producing a radiation pattern that covers the three-dimensional space around the mobile device.

Figure 1A:
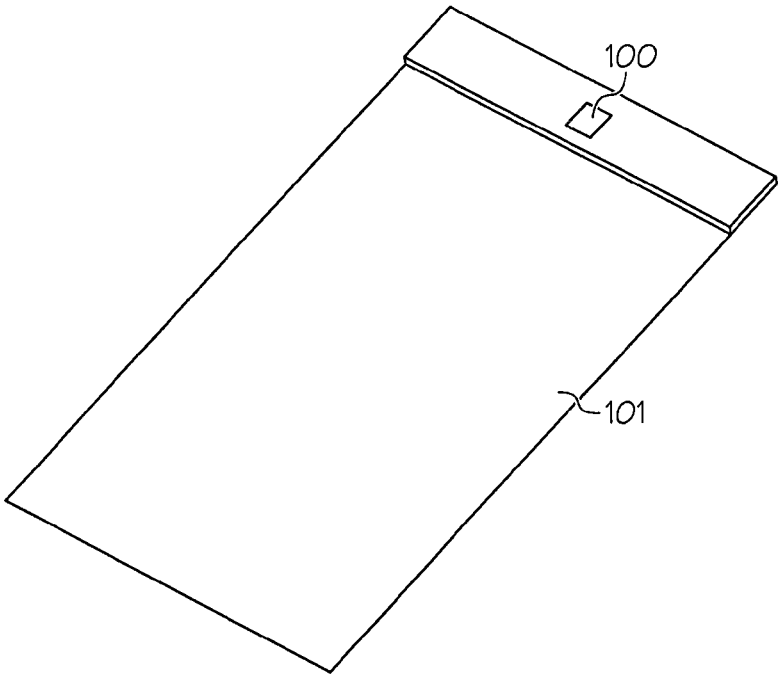
FIGS. 1A and 2A illustrate single patch antennas, according to various embodiments of the present inventive concepts.
Figure 1B:
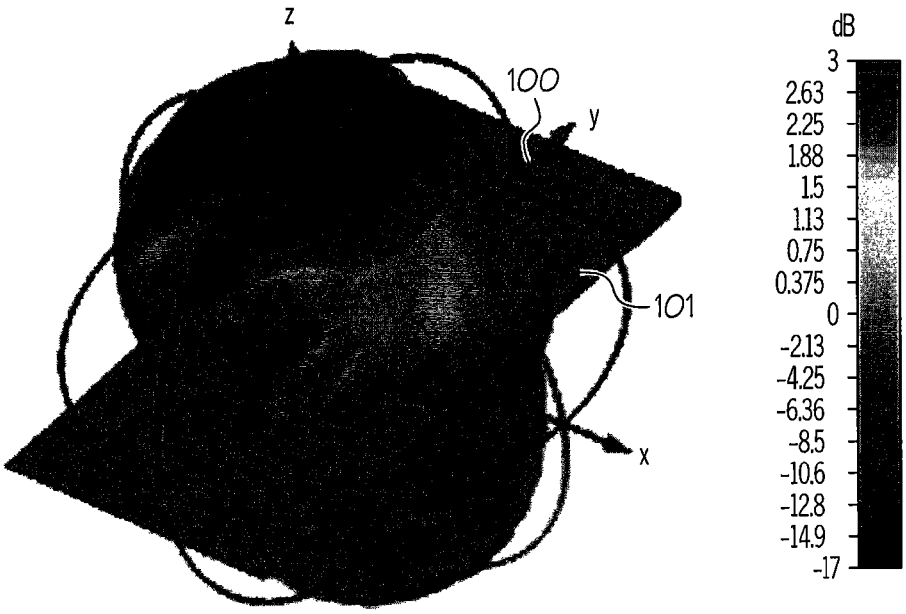
FIGS. 1B and 2B illustrate the radiation patterns around a wireless electronic device such as a smartphone, including the single patch antennas of FIGS. 1A and 2A, according to various embodiments of the present inventive concepts.
Figure 2A:
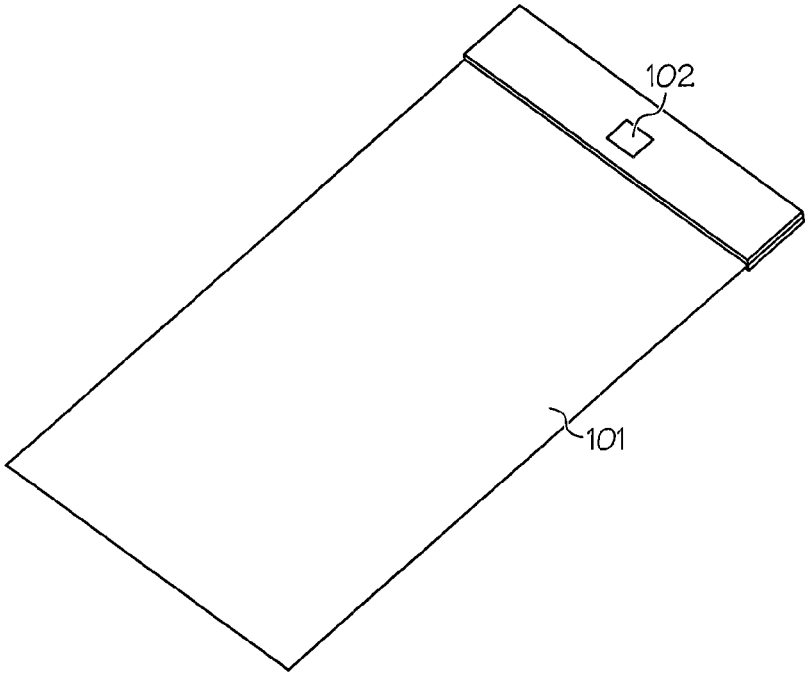
Figure 2B:
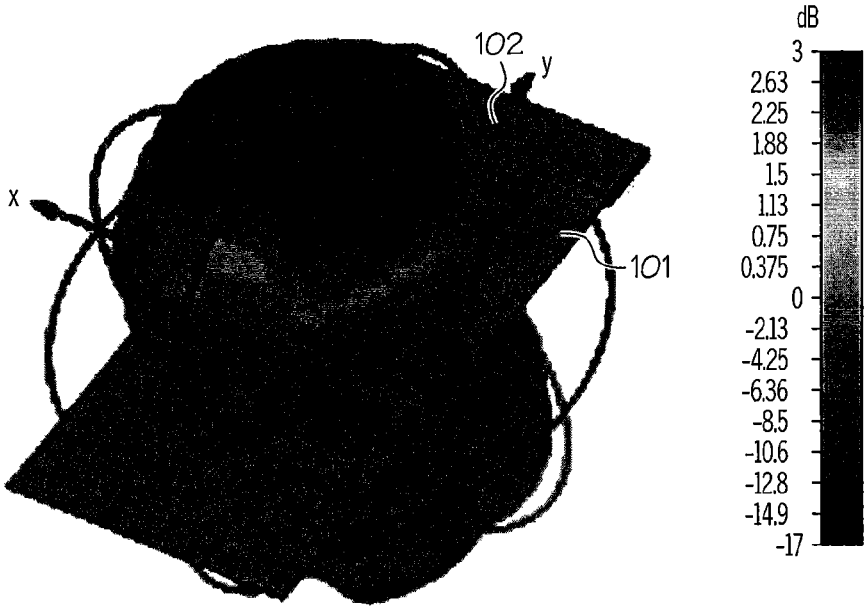

Referring now to FIG. 1A, a single patch antenna 100 on the front side of a wireless electronic device 101 us illustrated. The single patch antenna 100 is positioned along an edge of the wireless electronic device 101. Referring now to FIG. 1B, the radiation pattern around a wireless electronic device 101 including the single patch antenna 100 of FIG. 1A is illustrated. When the single patch antenna 100 is excited at 15.1 GHz, an irregular radiation pattern is formed around the wireless electronic device 101. Referring now to FIG. 2A, a single patch antenna 102 on the back side of a wireless electronic device 101 is illustrated. When the single patch antenna 102 is excited at 15.1 GHz, an irregular radiation pattern is formed around the wireless electronic device 101. In both cases, the radiation pattern around the wireless electronic device 101 exhibits directional distortion with broad, even radiation covering one half the space around the antenna but poor radiation around the other half of the antenna. Hence, this single patch antenna may not be suitable for communication at these frequencies since some orientations exhibit poor performance.

Figure 3:
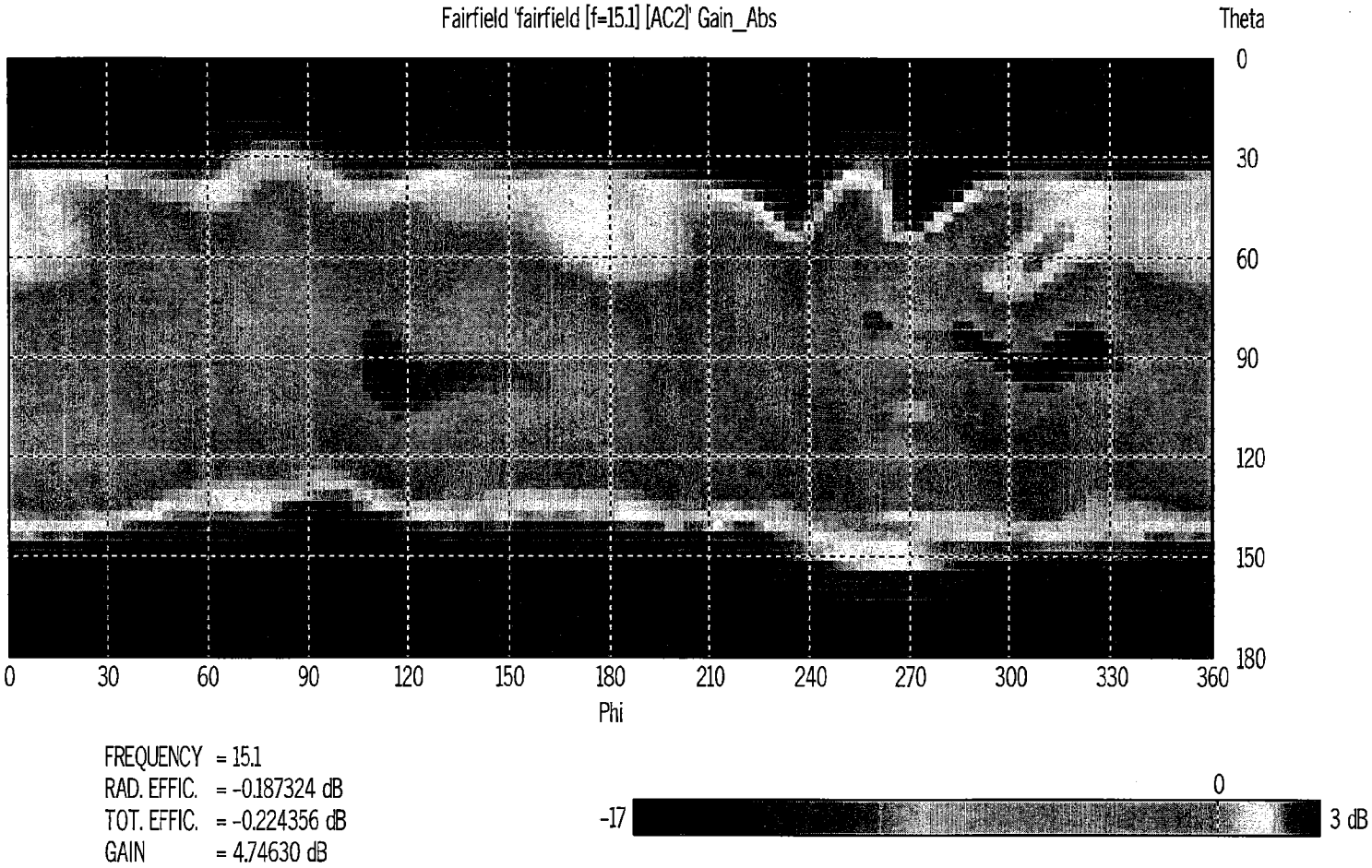
FIG. 3 illustrates the absolute far field gain, at 15.1 GHz excitation, along a wireless electronic device including the single patch antenna of FIG. 1A, according to various embodiments of the present inventive concepts.

Referring now to FIG. 3, the absolute far field gain, at 15.1 GHz excitation, along a wireless electronic device 101 including the single patch antenna 100 of FIG. 1A is illustrated. The axis Theta represents the y-z plane while the axis Phi represents the x-y plane around the wireless electronic device 101 of FIG. 1B. Similar to the resulting radiation pattern of FIG. 1B, the absolute far field gain exhibits satisfactory gain characteristics in one direction around the wireless electronic device 101, such as, for example, spanning broadly, for example, 0° to 360°, in the x-y plane. However, in the y-z plane, but poor absolute far field gain results are obtained such as, for example, 60° to 120° around the wireless electronic device 101.

Figure 4:
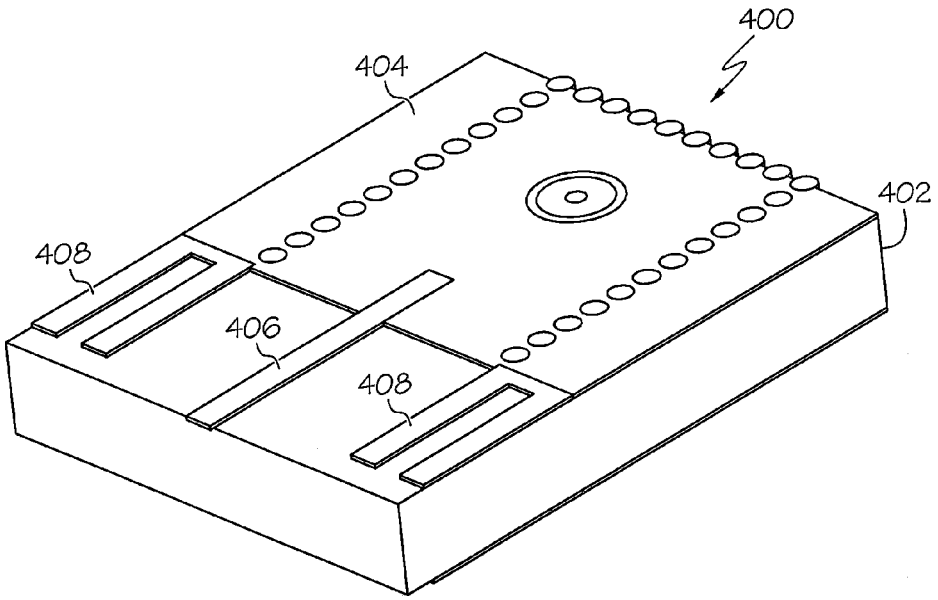
FIGS. 4, 5A, and 5B illustrate wideband antennas including a Substrate Integrated Waveguide (SIW), according to various embodiments of the present inventive concepts.

Referring now to FIG. 4, the diagram illustrates a wireless electronic device that includes a wideband SIW antenna 400 with a Substrate Integrated Waveguide (SIW) in substrate 402. The substrate 402 may include a material with a high dielectric constant and a low dissipation factor tan δ. For example, a material such as Rogers RO4003C may be used as the dielectric layer of the substrate 402, such that the dielectric constant $\in_r$=3.55 and the dissipation factor tan δ=0.0027 at 10 GHz. The wideband SIW antenna 400 includes a first metal layer 404, a reflector 406, and/or wave traps 408. The wave traps 408 are each directly connected to the first metal layer 404 and extend outward along a major plane of a first side of the first metal layer 404. The reflector 406 is configured to radiate and/or reflect signals of the wideband SIW antenna 400. Signals reflected by reflector 406 may be of greatest strength between the wave traps 408. In some embodiments, signals reflected by reflector 406 may be mitigated as they travel beyond the wave traps 408.

Figure 5A:
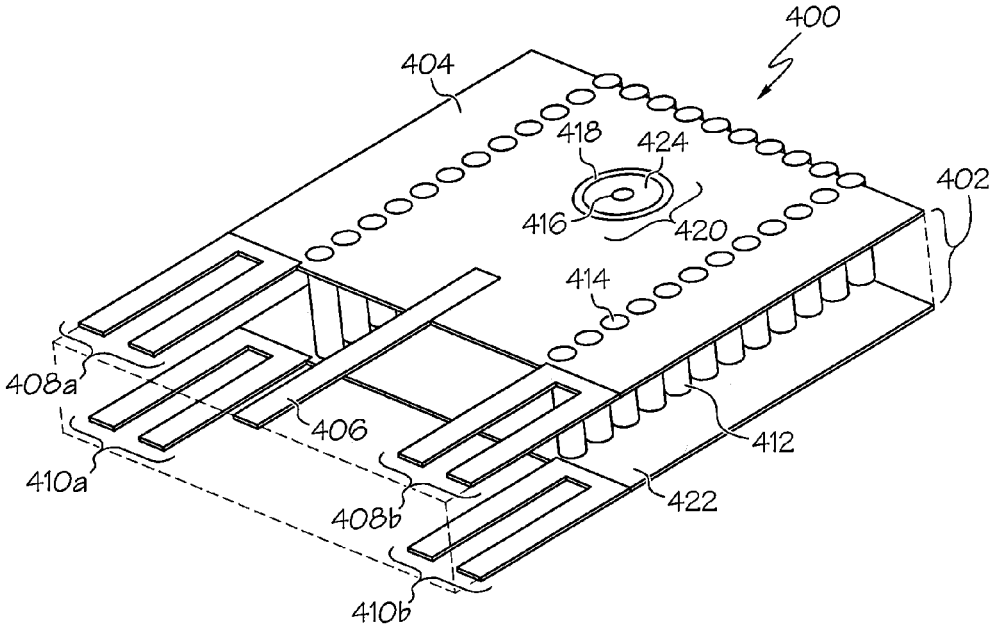

In high frequency applications, microstrip devices may not efficient due to losses. Additionally, since the wavelengths at high frequencies are small, manufacturing of microstrip device may require very tight tolerances. Therefore, at high frequencies dielectric-filled waveguide (DFW) devices may be preferred. However, manufacture of conventional waveguide devices may be difficult. For ease of manufacture, DFW devices may be enhanced by using vias to form a substrate integrated waveguide (SIW). Referring now to FIG. 5A, a detailed view of the wideband SIW antenna 400 of FIG. 4 is illustrated. The substrate 402 includes a grid-like Substrate Integrated Waveguide (SIW) 412 and vias 414. The vias 414 may form the side walls of the SIW 412 and extend from the first metal layer 404 into the SIW 412, as illustrated in FIG. 5A. In some embodiments, vias 414 may extend to a second metal layer 422, that is opposite the SIW 412 from the first metal layer 404.

Still referring to FIG. 5A, a feeding structure 420 may extend from the first metal layer 404 into the SIW 412. The feeding structure 420 may include a feed via 416 and a ring structure 418 that is spaced apart from and surrounds the feed via 416. An insulator 424 may be between the ring structure 418 and the feed via 416. In some embodiments, a radius of the ring structure 418 and/or a width of the ring structure 418 may be configured to impedance match a signal feeding element that is electrically coupled to the feeding structure 418. The feeding structure 420 may be fed through signal feeding element such as, for example, a RF/coaxial cable and/or a microstrip connected to the feeding structure. The wideband SIW antenna 400 may be configured to resonate at a resonant frequency when excited by a signal transmitted and/or received through the feeding structure 420. Although FIG. 5A illustrates a coaxial cable as an example feed to the feeding structure 418, the feed to the feeding structure 418 may include a microstrip, a stripline, and/or other types of feeds. The type of feed to the feeding structure 418 may not affect the performance of the antenna including the reflector and/or wavetraps.

Still referring to FIG. 5A, the wideband SIW antenna 400 may include top wave traps 408*a* and 408*b* and/or bottom wave traps 410*a* and 410*b*. Top wave traps 408*a* and 408*b* may each be directly connected to the first metal layer 404 and may extend outward along a major plane of a first side of the first metal layer 404. Bottom wave traps 410*a* and 410*b* may each be directly connected to the second metal layer 422 and may extend outward along a major plane of a first side of the second metal layer 422. The reflector 406 may be directly connected to the first metal layer and extend outward along a major plane of a first side of the first metal layer 404. The length of the reflector 406 extending away from the SIW 412 may be between 0.25 effective wavelengths and 0.5 effective wavelengths of the resonant frequency wideband SIW antenna 400. The effective wavelength may depend upon the permittivity of the substrate of the wideband SIW antenna 400 and/or the wavelength of the resonant frequency.

In some embodiments, the top wave traps 408*a* and 408*b* may be vertically aligned with bottom wave traps 410*a* and 410*b*, respectively. Top wave trap 408*a*, top wave trap 408*b*, and the reflector 406 may be approximately parallel to one another along the major plane of the first side of the SIW 412. The reflector 406 may be spaced apart from and/or equally distant from the top wave trap 408*a* and the top wave trap 408*b*. In some embodiments, top wave trap 408*a* and top wave trap 408*b* may be directly connected to the first metal layer 404 and/or may not overlap the SIW 412.

In some embodiments, top wave traps 408*a*, 408*b* may be notches in the first metal layer 404. The top wave trap 408*a* may include a first portion and a second portion. The first portion of the top wave trap 408*a* may be parallel to and/or spaced apart from the second portion of the top wave trap 408*a*. In some embodiments, an insulating material may be included between the first portion and the second portion of the top wave trap 408*a*. The first portion of the top wave trap 408*a* and the second portion of the top wave trap 408*a* may extend equally distant away from the SIW 412. A length of the first portion of the top wave trap 408*a* extending away from the SIW 412 may be between 0.25 effective wavelengths and 0.5 effective wavelengths of the resonant frequency wideband SIW antenna 400. A length of the second portion of the top wave trap 408*a* extending away from the SIW 412 may be between 0.25 effective wavelengths and 0.5 effective wavelengths of the resonant frequency wideband SIW antenna 400. In some embodiments, the dimensions of the reflector 406 and/or the dimensions of the wavetraps may be based on the material of the substrate of the wideband SIW antenna 400.

Similarly, bottom wave traps 410*a*, 410*b* may be notches in the second metal layer 422. The bottom wave trap 410*a* may include a first portion and a second portion. The first portion of the bottom wave trap 410*a* may be parallel to and/or spaced apart from the second portion of the bottom wave trap 410*a*. The top wave trap 408*a* and the top wave trap 408*b* may be equally distant from the feeding structure 420.

Still referring to FIG. 5A, top wave trap 408*a* may be on a first side of feeding structure 420 and top wave trap 408*b* may be on a second side of the feeding structure 420 that is opposite the first side of the feeding structure 420. Top wave trap 408*a* and top wave trap 408*b* may be equally distant from the feeding structure 420. In some embodiments, vias 414 may extend from the first metal layer 404 to the second metal layer 422. The vias 414 may include conductive material in via holes in the first metal layer 404 and/or the second metal layer 422. The first metal layer 404 may include top via holes spaced apart and along the first metal layer overlapping the SIW. The second metal layer 422 may include bottom via holes that are approximately vertically aligned with respective ones of the top via holes. The feeding structure 420 may be between at least two of the plurality of top via holes in the first metal layer.

Figure 5B:
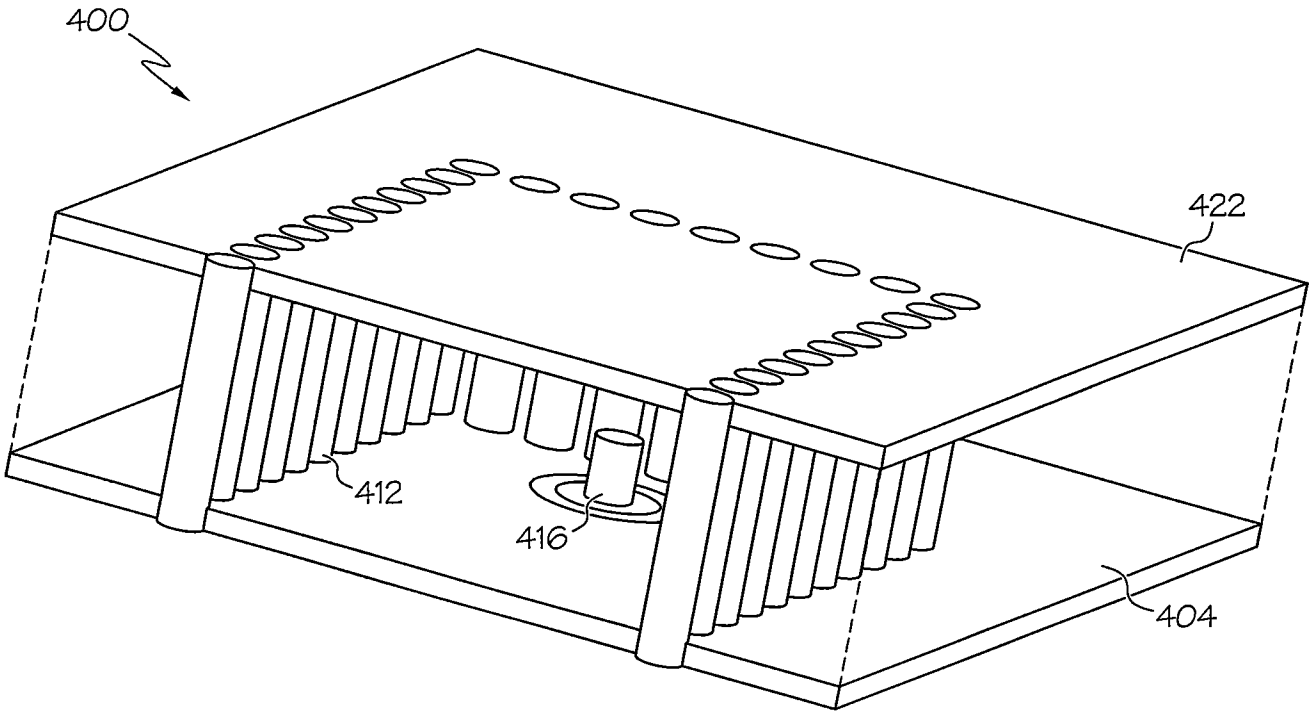

Referring now to FIG. 5B, a flipped over view of wideband SIW antenna 400 of FIG. 5A is illustrated. The feed via 416 may extend through the first metal layer 404 into the SIW 412. In some embodiments, the feed via 416 may extend through the first metal layer 404 into the SIW 418, and to the second metal layer 422.

Figure 6:
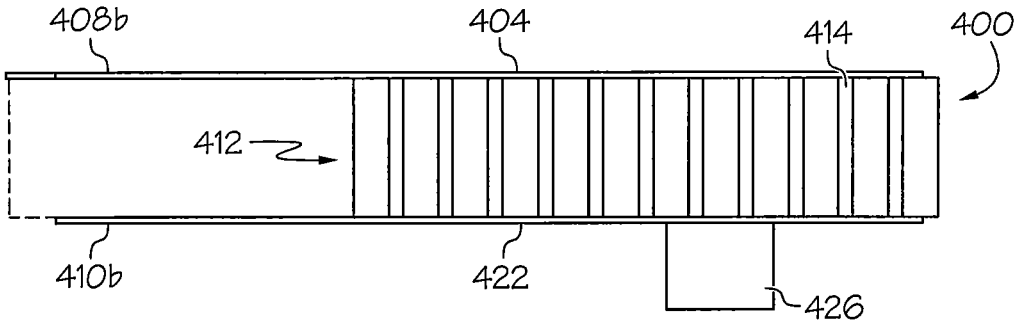
FIGS. 6 to 8 illustrate cross-sectional views of any of the wideband antennas including SIWs of FIGS. 4, 5A, and/or 5B, according to various embodiments of the present inventive concepts.
Figure 7:
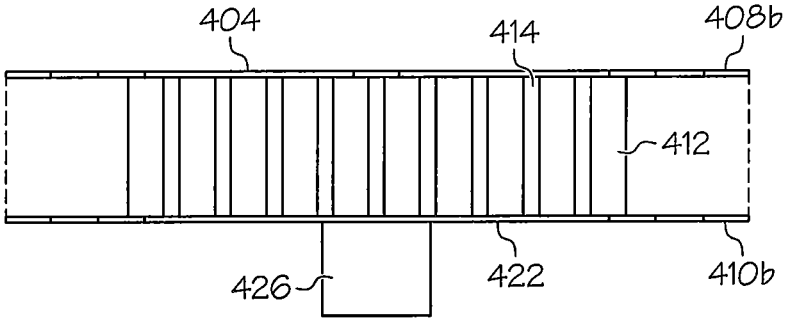
Figure 8:
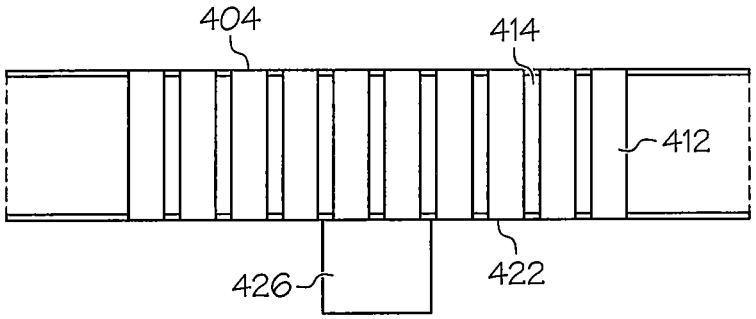

FIGS. 6, 7, and 8 illustrate cross-sectional views of any of the wideband antennas including SIWs of FIGS. 4, 5A, and 5B. Referring now to FIG. 6, a side view of the wideband SIW antenna 400 including SIW 412 is illustrated. Vias 414 extend from the first metal layer 404 to the second metal layer 422. A signal feeding element 426 may be connected to the feeding structure of the wideband SIW antenna 400. A top wave trap 408*b* extends from the first metal layer 404 and a bottom wave trap 410*b* extends from the second metal layer 422. Referring now to FIG. 7, a back view of the wideband SIW antenna 400 including SIW 412 is illustrated. Vias 414 extend from the first metal layer 404 to the second metal layer 422. A signal feeding element 426 may be connected to the feeding structure of the wideband SIW antenna 400. Referring now to FIG. 8, a front view of the wideband SIW antenna 400 including SIW 412 is illustrated. Vias 414 extend from the first metal layer 404 to the second metal layer 422. A signal feeding element 426 may be connected to the feeding structure of the wideband SIW antenna 400.

Figure 9A:
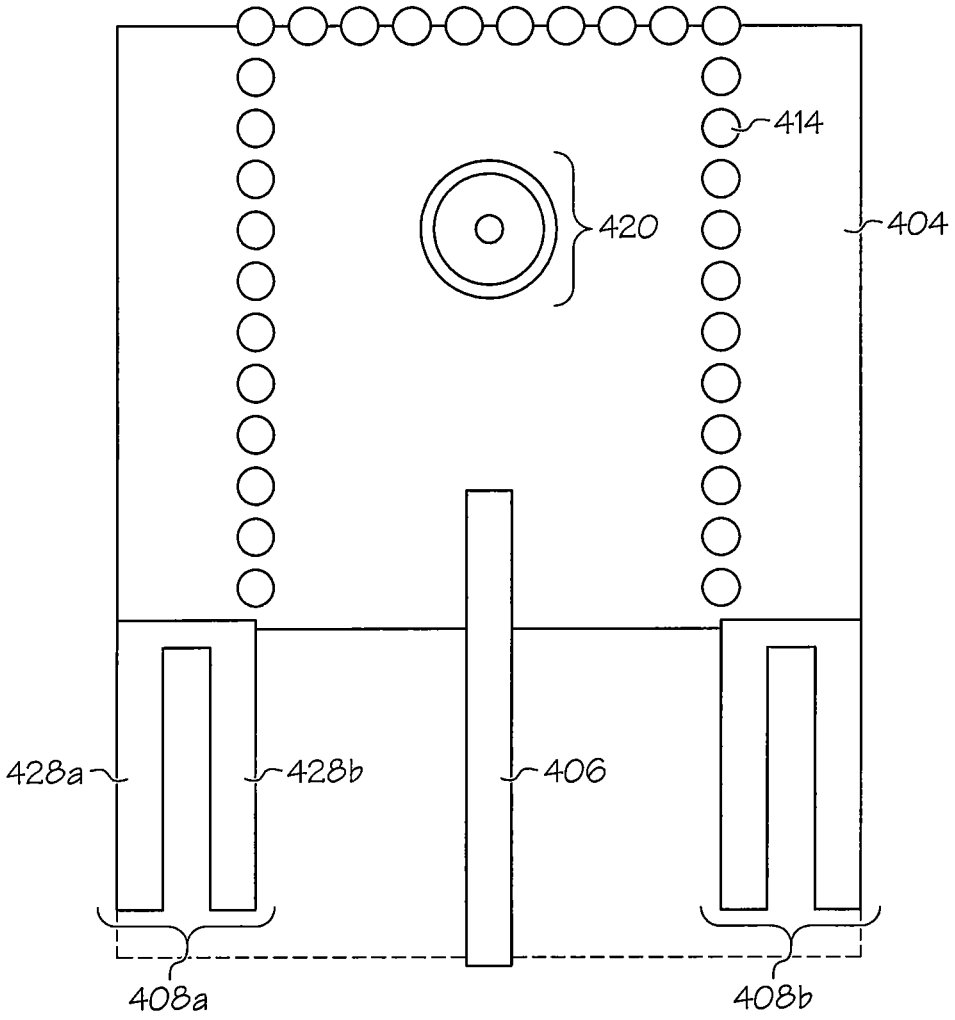
FIGS. 9A and 9B illustrate plan views of any of the wideband antennas including SIWs of FIGS. 4, 5A, and/or 5B, according to various embodiments of the present inventive concepts.

Referring now to FIG. 9A, a top plan view of any of the wideband SIW antennas 400 of FIGS. 4, 5A, and 5B is illustrated. The first metal layer 404 includes vias 414 arranged around the feed structure 420. A reflector 406 extends from the first metal layer 404. Top wave traps 408*a*, 408*b* may be notches in the first metal layer 404. The top wave trap 408*a* may include a first portion 428*a* and a second portion 428*b*. The first portion 428*a* of the top wave trap 408*a* may be parallel to and/or spaced apart from the second portion 428*b* of the top wave trap 408*a*. The first portion 428*a* of the top wave trap 408*a* and the second portion 428*b* of the top wave trap 408*a* may extend equally distant away from the first metal layer 404 that overlaps an SIW below the first metal layer 404. The first portion 428*a* of the top wave trap 408*a* and the second portion 428*b* of the top wave trap 408*a* may be separated by an dielectric material.

Figure 9B:
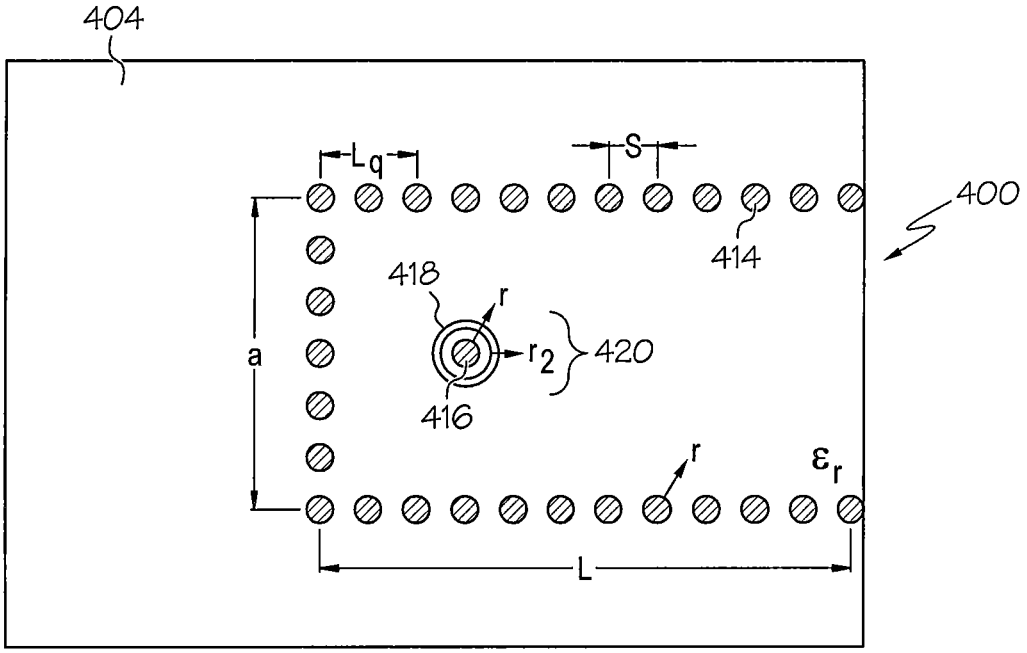

Referring now to FIG. 9B, a top plan view of any of the wideband SIW antennas 400 of FIGS. 4, 5A, and 5B is illustrated. The feeding structure 420 may include a feed via hole 416 and a ring structure 418. The radius "r" of the feed via hole, the radius "r2" of the ring structure 418, and/or the thickness of the ring structure 418 may control the impedance of the feeding structure 420. The substrate of the wideband SIW antenna 400 may include a material with a high dielectric constant $\in_r$. Spacing between the vias 414 may be a distance "S". The distance from a via 414 closest to a first side of the first metal layer 404 that includes the wave traps and a back row of vias 414 may be a distance "L". The distance between the two rows of vias 414 parallel to the reflector and/or wave traps may be a distance "a". The distance from a back row of vias 414 and the feed structure 420 may be a distance "$L_q$". The distances "S", "a", "L", and/or "$L_q$" may affect the bandwidth and/or resonant frequency of the wideband SIW antenna 400.

Figure 9C:
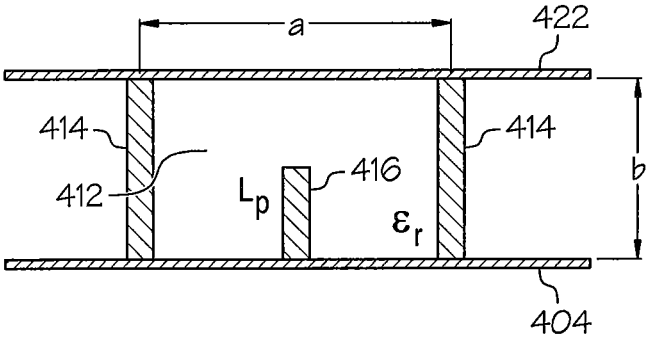
FIG. 9C illustrates a cross-sectional view including a feeding structure, of any of the wideband antennas including SIWs of FIGS. 4, 5A, and/or 5B, according to various embodiments of the present inventive concepts.

Referring now to FIG. 9C, a cross-sectional back view of any of the wideband SIW antennas 400 of FIGS. 4, 5A, and 5B is illustrated. The feeding via 416 may extend from the first metal layer 404 into the SIW of the substrate with a high dielectric constant $\in_r$. The feeding via may have a height $L_p$. In some embodiments, the height $L_p$ may determine the resonant frequency. Vias 414 may extend from the first metal layer 404 to the second metal layer 422.

Figure 10:
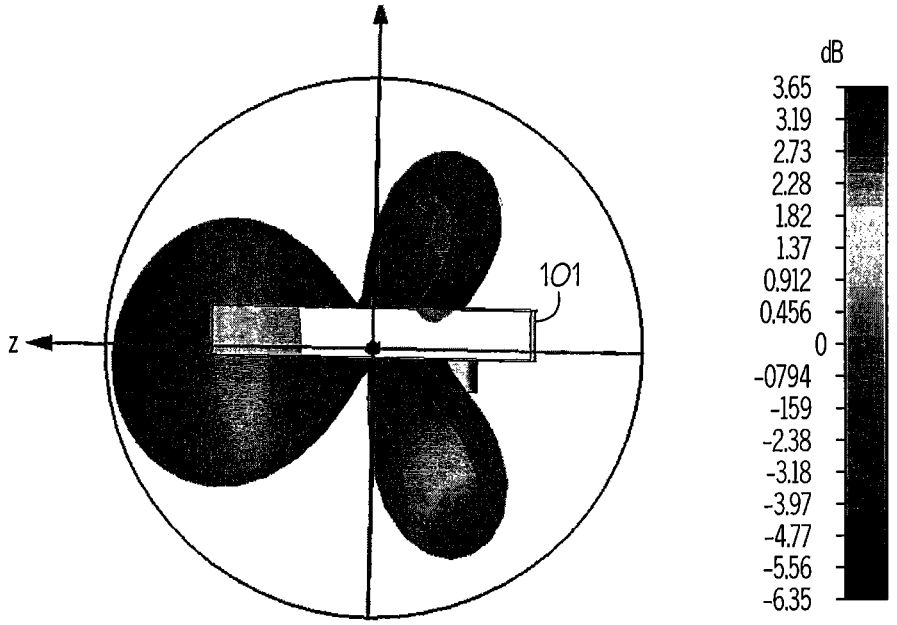
FIGS. 10 to 12 illustrate the radiation pattern around a wireless electronic device such as a smartphone, including different wideband antenna designs, according to various embodiments of the present inventive concepts.
Figure 11:
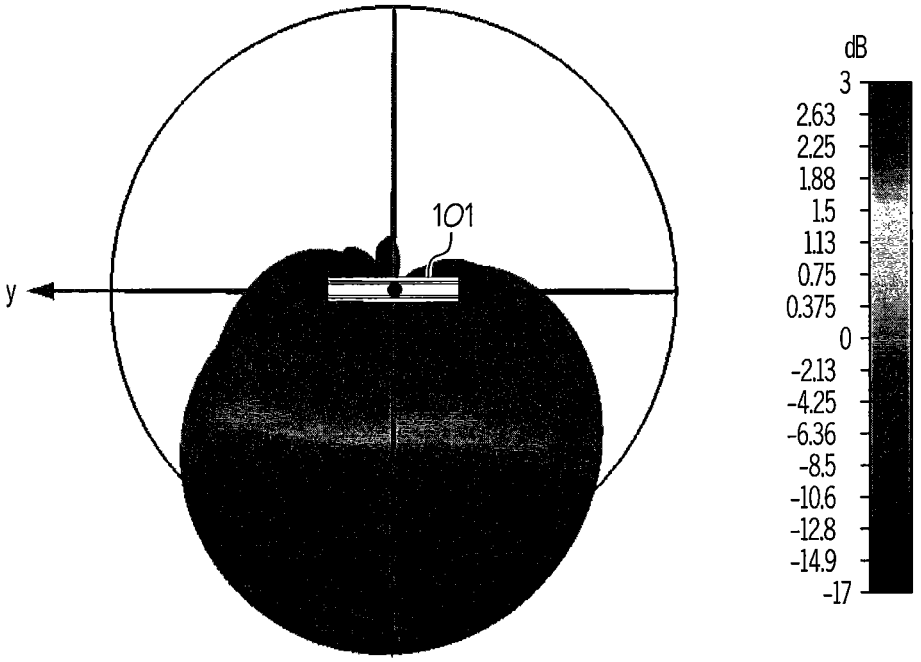

Referring now to FIG. 10, the radiation pattern around a wireless electronic device 101 such as a smartphone, including a conventional SIW antenna is illustrated. An irregular radiation pattern is formed around the wireless electronic device 101 including the conventional SIW antenna. The radiation pattern around the wireless electronic device 101 exhibits significant directional distortion. Referring now to FIG. 11, the radiation pattern around a wireless electronic device 101 such as a smartphone, including the single patch antenna of FIG. 1A is illustrated. The radiation pattern exhibits significant directional behavior such that the wireless electronic device 101 may exhibit good performance in certain orientations since only one direction of the wireless electronic device 101 has good radiation properties, as illustrated in FIG. 11.

Figure 12:
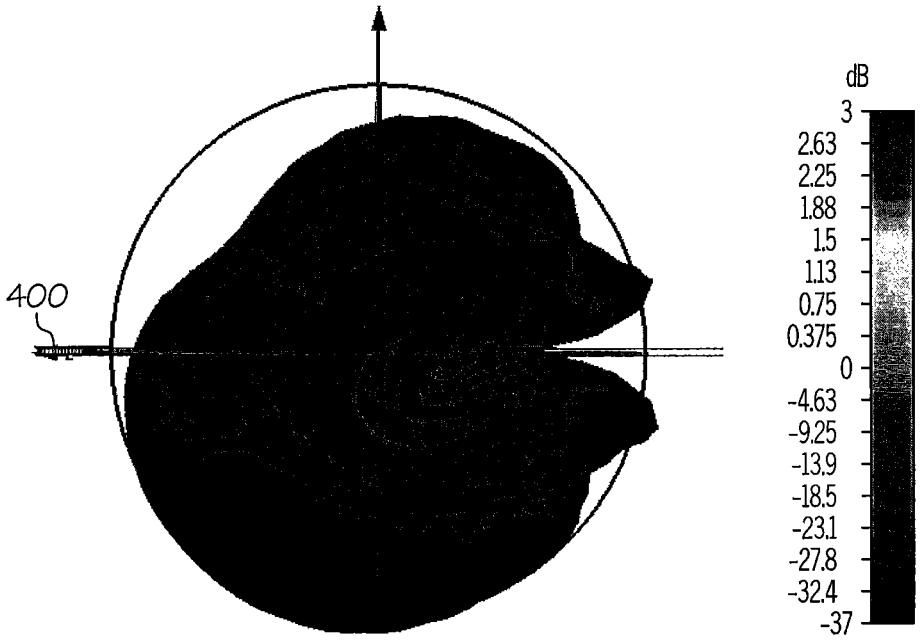

Referring now to FIG. 12, the radiation pattern around a wireless electronic device 101 such as a smartphone, including a wideband SIW antenna 400 of any of FIGS. 4, 5A, and/or 5B is illustrated. The radiation pattern around the wireless electronic device 201 exhibits little directional distortion with broad, encompassing radiation covering the space around the front and the back of the wireless electronic device including the wideband SIW antenna 400.

Figure 13:
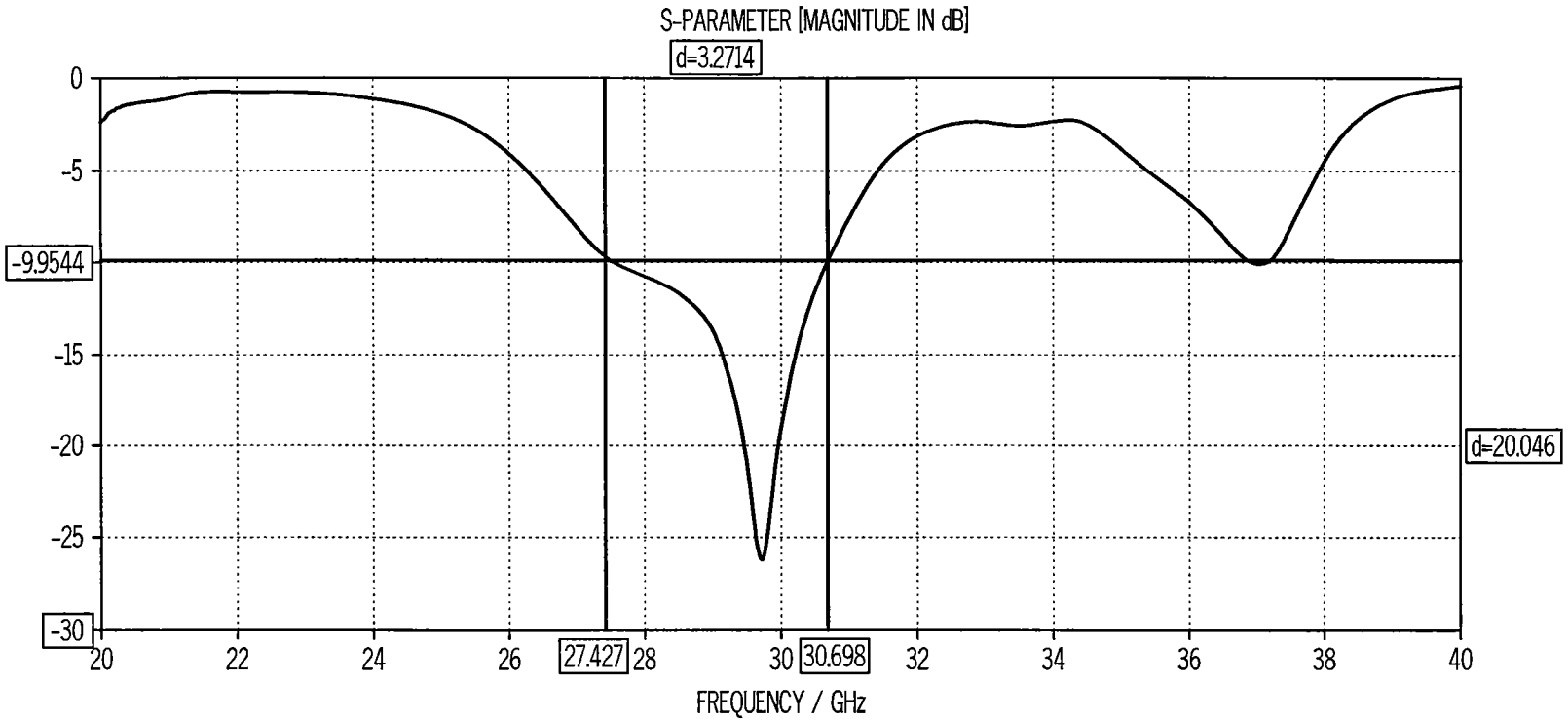
FIG. 13 graphically illustrates the frequency response of the wideband antenna including and SIW of FIGS. 4, 5A, and/or 5B.

Referring to FIG. 13, the frequency response of the wideband SIW antenna 400 of any of FIG. 4, 5A, or 5B is illustrated. In this non-limiting example, the wideband SIW antenna 400 of FIG. 4, 5A, or 5B is designed to have a resonant frequency response near 30 GHz. The bandwidth with −10 dB return loss around this resonant frequency may be about 3.0 GHz. This wide bandwidth with low return loss provided by this antenna around the resonant frequency offers excellent signal integrity with potential for use at several different frequencies in this bandwidth range.

Figure 14:
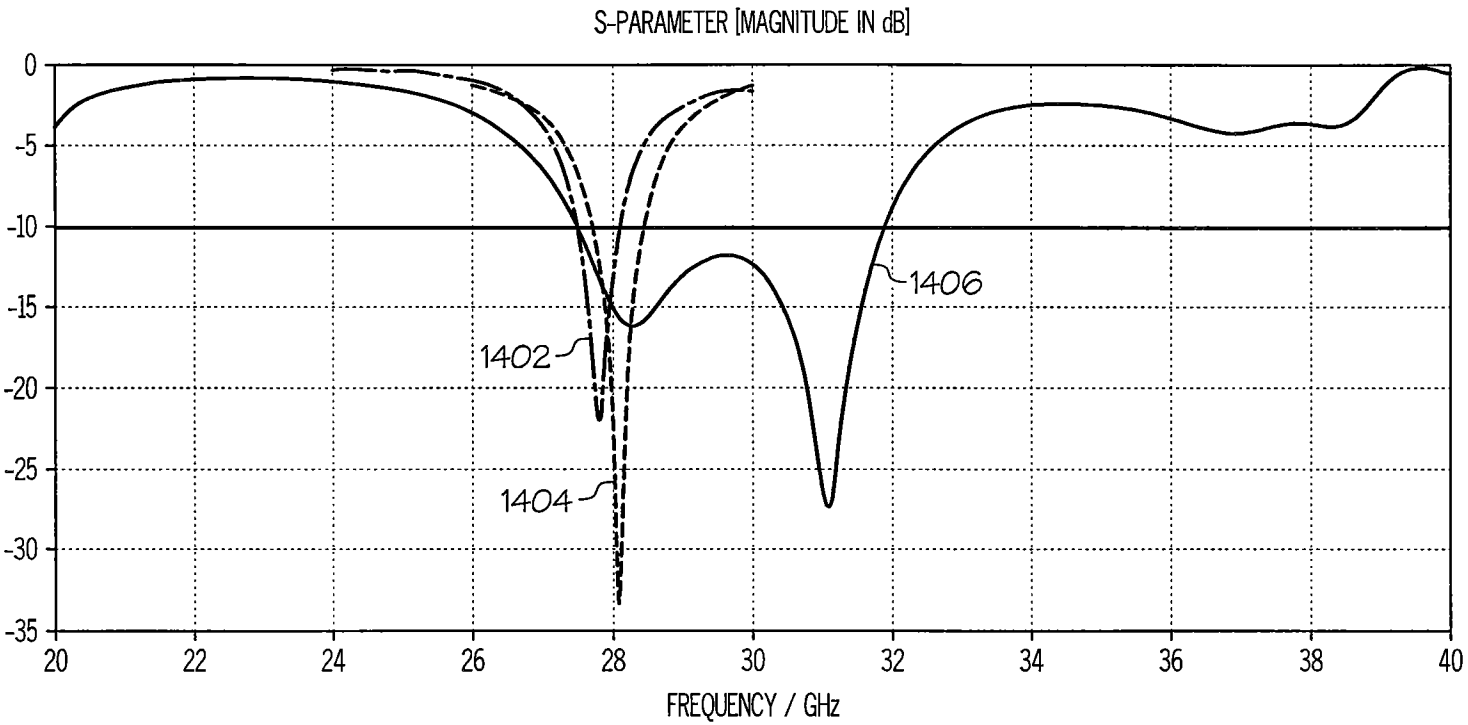
FIG. 14 graphically illustrates the frequency response of different types of antennas, according to various embodiments of the present inventive concepts.

Referring to FIG. 14, the frequency response 1406 of the wideband SIW antenna 400 of any of FIG. 4, 5A, or 5B is illustrated in comparison to the frequency response 1404 of the patch antenna of FIG. 1A and the frequency response 1402 of a conventional SIW antenna. The frequency response 1406 of the wideband SIW antenna provides a much greater bandwidth (i.e. >3 GHz) when compared to the patch antenna or the conventional SIW antenna.

Figure 15:
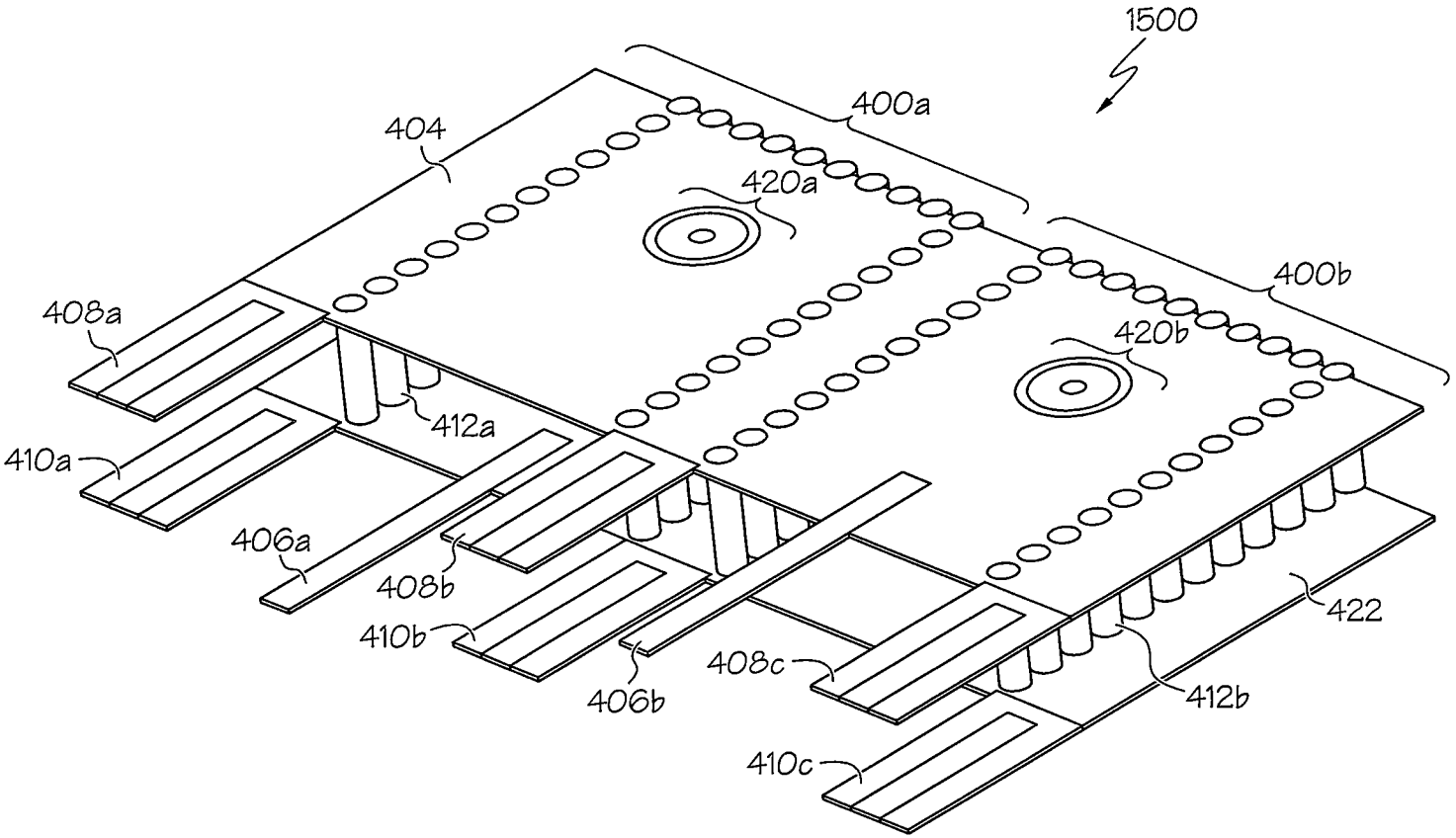
FIG. 15 illustrates a dual directional array antenna including SIWs, according to various embodiments of the present inventive concepts.

Referring now to FIG. 15, a dual directional wideband array antenna 1500 including two SIWs is illustrated. For ease of discussion, two antenna elements 400*a* and 400*b* are illustrated. However, the concepts may be applied to an array including additional antenna elements such as, for example, four or more antenna elements for Multiple-Input Multiple-Output (MIMO) applications and/or for diversity communication. Antenna elements may be grouped into subarrays for use in MIMO communications. The wideband array antenna 1500 of FIG. 15 may include two wideband SIW antennas 400*a* and 400*b* that are adjacent to one another. Antenna 400*b* may be similar to the antenna 400 of FIG. 5A. Two SIWs, 412*a* and 412*b* may be included in the wideband array antenna 1500. These SIWs may be spaced apart. Top wave traps 408*a*, 408*b*, and 408*c* may extend from the first metal layer 404. Bottom wave traps 410*a*, 410*b*, and 410*c* may extend from the second metal layer 422. Top wave trap 408*b* may be between the two SIWs 412*a* and 412*b*, and bottom wave trap 410*b* may be between the two SIWs 412*a* and 412*b*. Top wave trap 408*b* and bottom wave trap 410*b* may function to trap and/or shape radiating signals from both wideband SIW antennas 400*a* and 400*b*. Reflector 406*b* of wideband SIW antenna 400*a* may be on the first metal layer 404 whereas the reflector 406*a* of the adjacent wideband SIW antenna 400*b* may on the second metal layer 422. In some embodiments with greater than two wideband SIW antennas, the reflectors of adjacent wideband SIW antennas may be on opposite metal layers. In other words, the location of the reflectors alternate between the first metal layer and second metal layer for adjacent wideband SIW antennas. This alternating reflector positioning may improve the dual directional behavior of the antenna and may provide lower power consumption by the device since signals between adjacent antenna elements provide less interference to one another. Each of the wideband SIW antennas 400*a* and 400*b* may include respective feeding structures 420*a* and 420*b*.

Figure 16A:
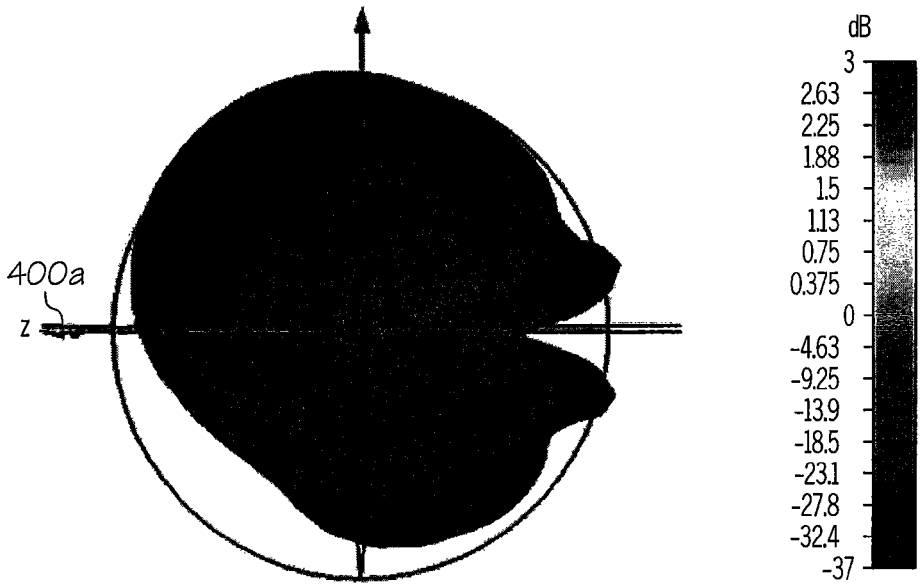
FIGS. 16A and 16B illustrate the radiation patterns around a wireless electronic device such as a smartphone, including the antenna of FIG. 15, according to various embodiments of the present inventive concepts.
Figure 16B:
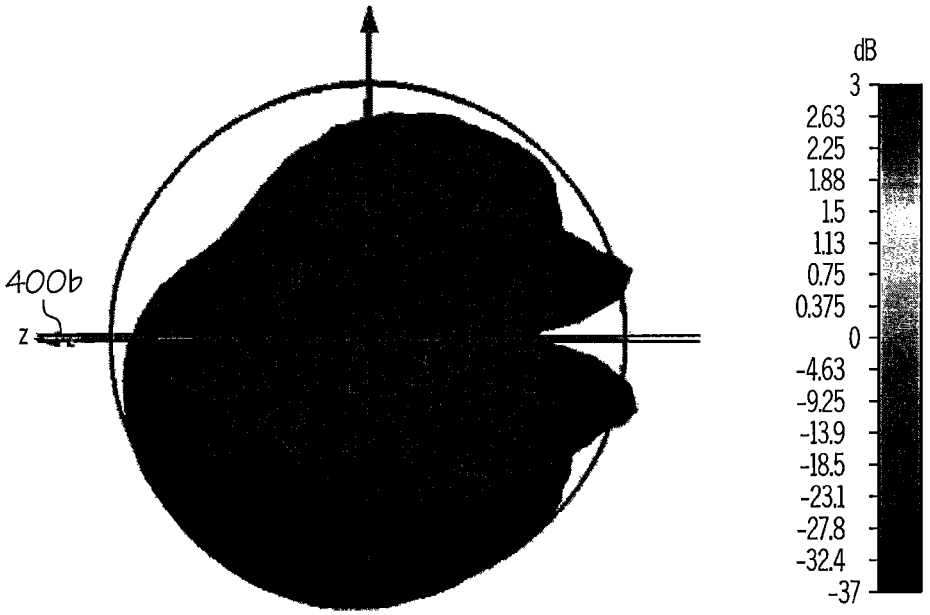

FIGS. 16A and 16B illustrate the radiation pattern around a wireless electronic device such as a smartphone, including the dual directional wideband array antenna 1500 of FIG. 15. Referring now to FIG. 16A, a radiation pattern due to the wideband SIW antenna element 400*a* of FIG. 15 is illustrated. The radiation pattern around the wireless electronic device exhibits little directional distortion with broad, encompassing radiation covering the space around front and back of the wireless electronic device including the wideband SIW antenna 400*a*. Referring now to FIG. 16B, a radiation pattern due to the wideband SIW antenna element 400*b* of FIG. 15 is illustrated. The radiation pattern around the wireless electronic device exhibits little directional distortion with broad, encompassing radiation covering the space around front and back of the wireless electronic device including the wideband SIW antenna 400*b*.

Figure 17:
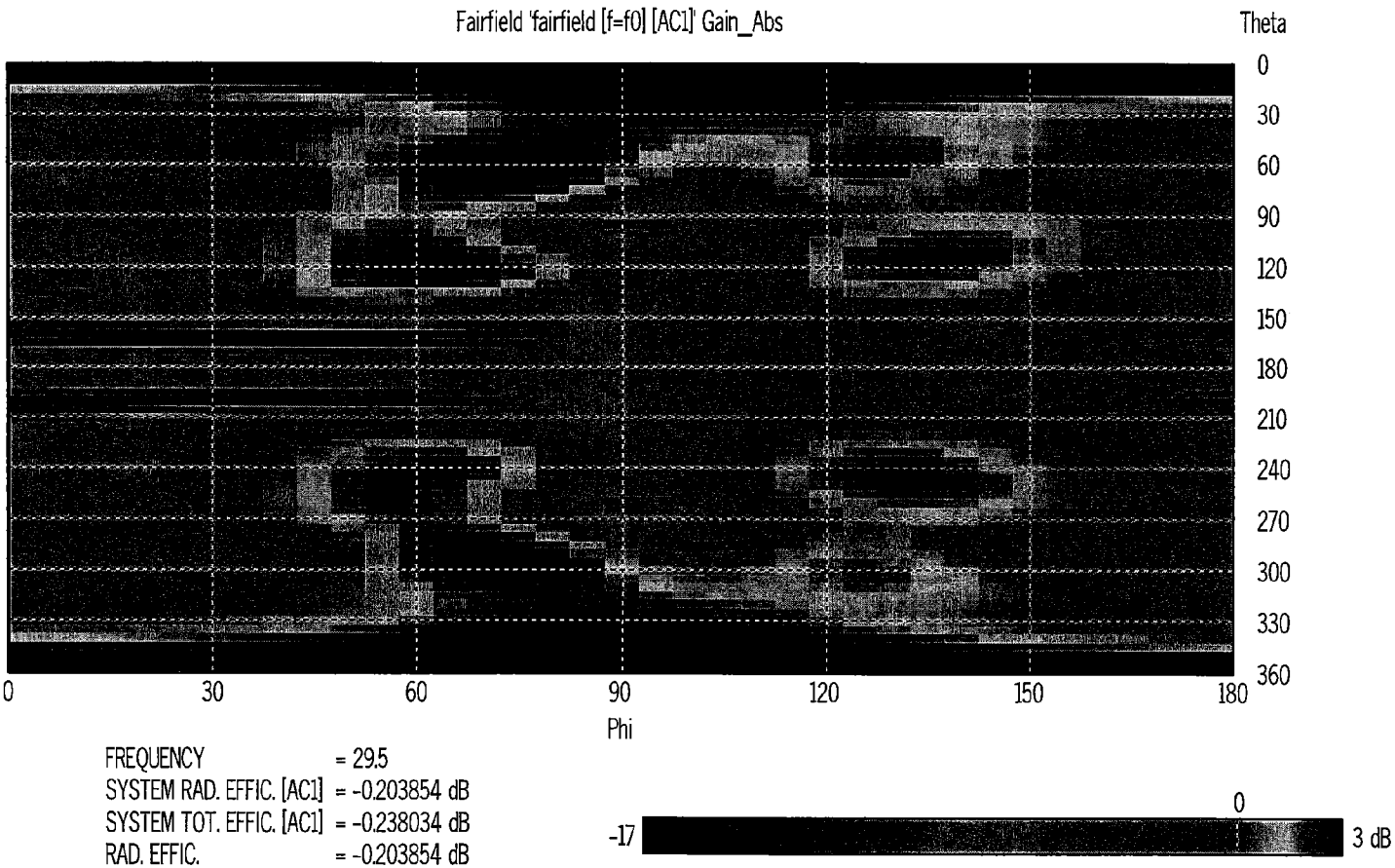
FIG. 17 illustrates the absolute far field gain, at 29.5 GHz excitation, along a wireless electronic device including the dual directional array antenna of FIG. 15, according to various embodiments of the present inventive concepts.

Referring now to FIG. 17, the absolute far field gain, at 29.5 GHz excitation, along a wireless electronic device including the dual directional wideband array antenna 1500 of FIG. 15 is illustrated. The axis Theta represents the y-z plane while the axis Phi represents the x-y plane around the dual directional wideband array antenna 1500 of FIG. 15. The absolute far field gain exhibits excellent gain characteristics in both the x-y plane and the y-z plane around the dual directional wideband array antenna 1500 of FIG. 15. The far field gain spans broadly in both directions, for example, 0° to 360°, in the y-z plane around the dual directional wideband array antenna 1500 of FIG. 15. As illustrated in FIG. 17, the dual directional wideband array antenna 1500 of FIG. 15 provides good gain characteristics compared to the poor absolute far field gain results for the patch antenna in FIG. 3 where the y-z plane exhibits 60° to 120° of signal coverage.

Figure 18:
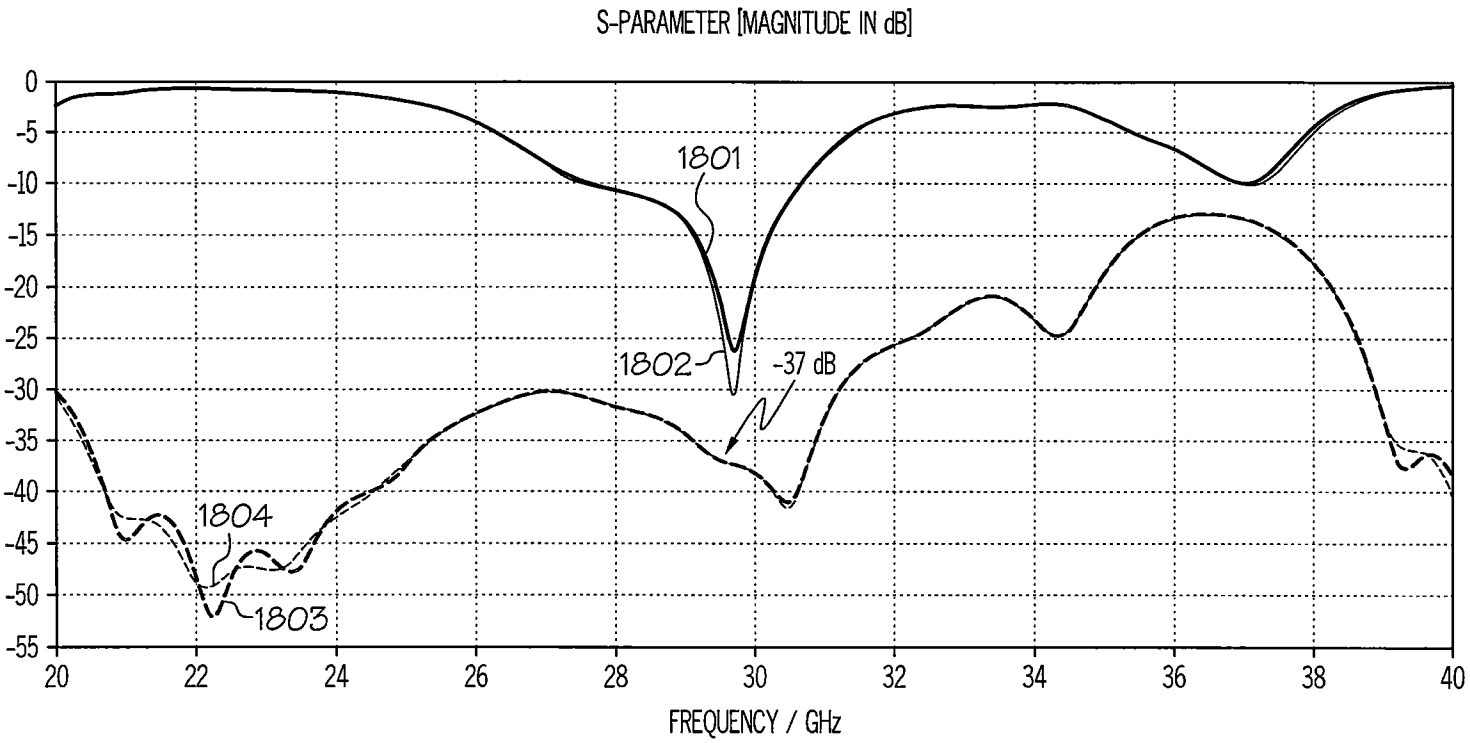
FIGS. 18 and 19 illustrates mutual coupling for various antennas, according to various embodiments of the present inventive concepts.

Additionally, the top wave traps 408 and bottom wave traps 410 of FIG. 15 significantly reduce mutual coupling between the adjacent antenna elements 400*a* and 400*b*, thereby reducing interference. Referring now to FIG. 18, the mutual coupling and return loss of the dual directional wideband array antenna 1500 of FIG. 15 is illustrated. Graphs 1803 and 1804 of FIG. 18 illustrate mutual coupling between the adjacent antenna elements 400*a* and 400*b*. At a resonant frequency of 29.5 GHz, the mutual coupling is around −37 dB, indicating very low mutual coupling due to the effects of the top wave traps 408 and bottom wave traps 410 of FIG. 15. Graphs 1801 and 1802 illustrate the return loss of the antenna elements 400*a* and 400*b*. At a resonant frequency of 29.5 GHz, the return loss is around −25 dB, indicating very low return losses for each of the antenna elements.

Figure 19:
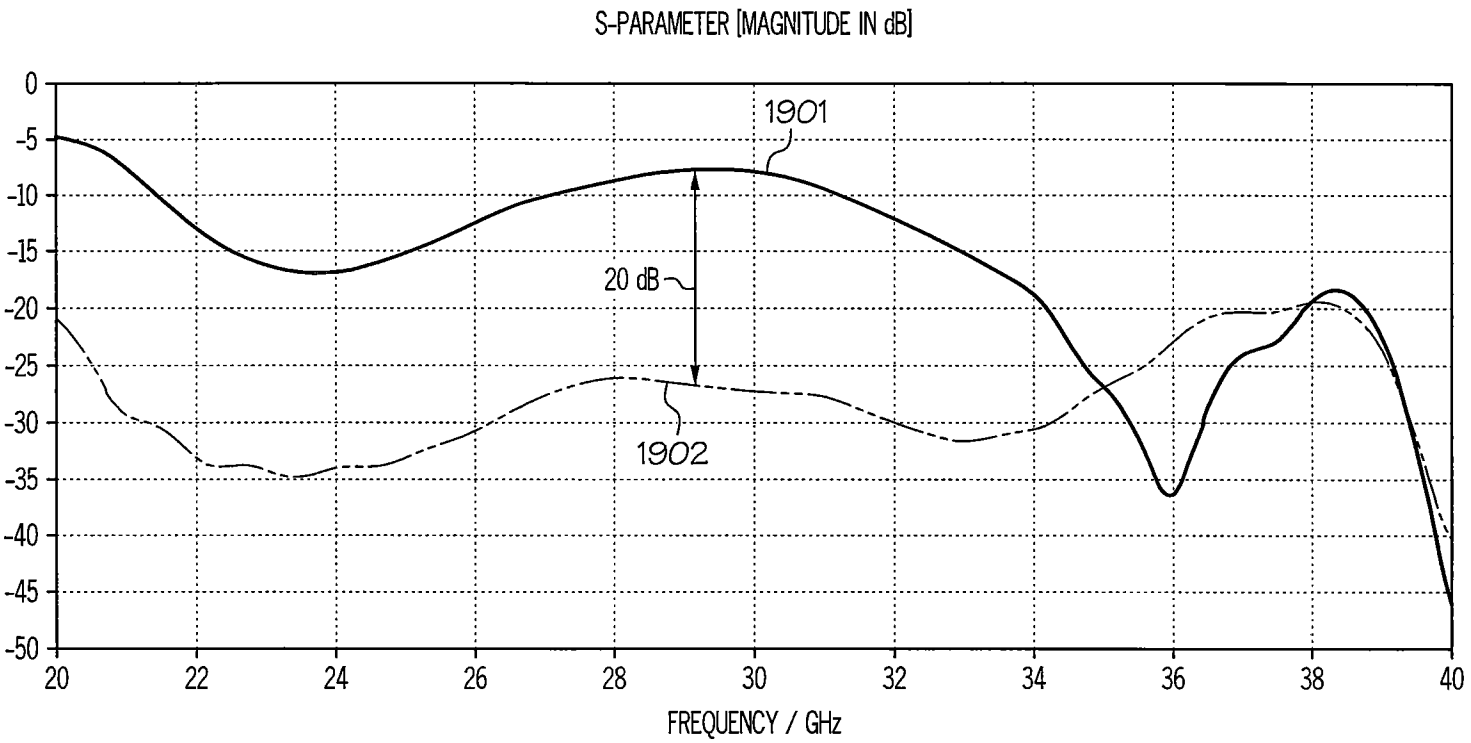

Referring now to FIG. 19, mutual coupling in array antennas with and without wave traps are illustrated. Graph 1901 illustrates mutual coupling in the dual directional wideband array antenna 1500 of FIG. 15 whereas graph 1902 illustrates a similar SIW array antenna without the wave traps. At a resonant frequency of 29.5 GHz, the difference in mutual coupling is about 20 dB, indicating significantly lower mutual coupling between antenna elements that include the wave traps as discussed herein.

Figure 20:
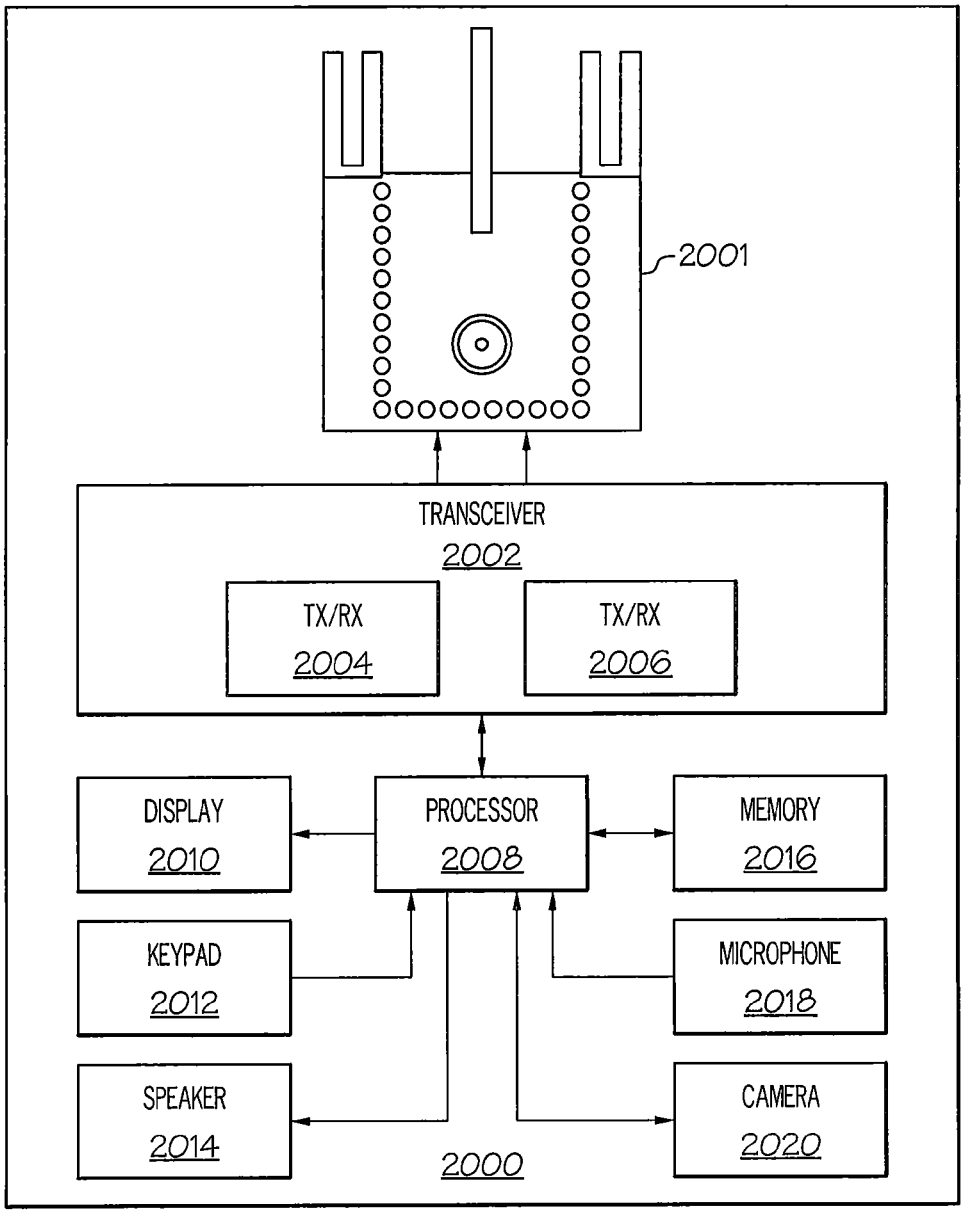
FIG. 20 is a block diagram of some electronic components, including a wideband antenna, of a wireless electronic device, according to various embodiments of the present inventive concepts.

FIG. 20 is a block diagram of a wireless communication terminal 2000 that includes an antenna 2001 in accordance with some embodiments of the present invention. The antenna 2001 may include the wideband SIW antenna 400 of any of FIG. 4, 5A, or 5B and/or may include the wideband array antenna 1500 of FIG. 15 and/or may be configured in accordance with various other embodiments of the present invention. Referring to FIG. 20, the terminal 2000 includes an antenna 2001, a transceiver 2002, a processor 2008, and can further include a conventional display 2010, keypad 2012, speaker 2014, memory 2016, microphone 2018, and/or camera 2020, one or more of which may be electrically connected to the antenna 2001.

The transceiver 2002 may include transmit/receive circuitry (TX/RX) that provides separate communication paths for supplying/receiving RF signals to different radiating elements of the antenna 2001 via their respective RF feeds. Accordingly, when the antenna 2001 includes two antenna elements 400*a* and 400*b*, such as shown in FIG. 15, the transceiver 2002 may include two transmit/receive circuits 2004, 2006 connected to different ones of the antenna elements via the respective feeding structures 420*a* and 420*b* of FIG. 15.

The transceiver 2002 in operational cooperation with the processor 2008 may be configured to communicate according to at least one radio access technology in one or more frequency ranges. The at least one radio access technology may include, but is not limited to, WLAN (e.g., 802.11), WiMAX (Worldwide Interoperability for Microwave Access), TransferJet, 3GPP LTE (3rd Generation Partnership Project Long Term Evolution), Universal Mobile Telecommunications System (UMTS), Global Standard for Mobile (GSM) communication, General Packet Radio Service (GPRS), enhanced data rates for GSM evolution (EDGE), DCS, PDC, PCS, code division multiple access (CDMA), wideband-CDMA, and/or CDMA2000. Other radio access technologies and/or frequency bands can also be used in embodiments according to the invention.

It will be appreciated that certain characteristics of the components of the antennas shown in FIGS. 4 to 9C, and 15 such as, for example, the relative widths, conductive lengths, and/or shapes of the radiating elements, and/or other elements of the antennas may vary within the scope of the present invention. Thus, many variations and modifications can be made to the embodiments without substantially departing from the principles of the present invention. All such variations and modifications are intended to be included herein within the scope of the present invention.

The above discussed antenna structures for wideband SIW antenna and arrays of wideband SIW antennas including wave traps may improve antenna performance by producing high gain signals that cover the three-dimensional space around a mobile device with uniform radiation patterns. In some embodiments, further performance improvements may be obtained by adding a reflector to improve the bandwidth of the wideband SIW antenna. The described inventive concepts create antenna structures with omnidirectional radiation and/or wide bandwidth.

The terminology used herein is for the purpose of describing particular embodiments only and is not intended to be limiting of the embodiments. As used herein, the singular forms "a," "an," and "the" are intended to include the plural forms as well, unless the context clearly indicates otherwise. It will be further understood that the terms "comprises," "comprising," "includes," "including,", "having," and/or variants thereof, when used herein, specify the presence of stated features, steps, operations, elements, and/or components, but do not preclude the presence or addition of one or more other features, steps, operations, elements, components, and/or groups thereof.

It will be understood that when an element is referred to as being "coupled," "connected," or "responsive" to another element, it can be directly coupled, connected, or responsive to the other element, or intervening elements may also be present. In contrast, when an element is referred to as being "directly coupled," "directly connected," or "directly responsive" to another element, there are no intervening elements present. As used herein, the term "and/or" includes any and all combinations of one or more of the associated listed items.

Spatially relative terms, such as "above," "below," "upper," "lower," "top," "bottom," and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" other elements or features would then be oriented "above" the other elements or features. Thus, the term "below" can encompass both an orientation of above and below. The device may be otherwise oriented (rotated 90 degrees or at other orientations) and the spatially relative descriptors used herein interpreted accordingly. Well-known functions or constructions may not be described in detail for brevity and/or clarity.

It will be understood that, although the terms "first," "second," etc. may be used herein to describe various elements, these elements should not be limited by these terms. These terms are only used to distinguish one element from another. Thus, a first element could be termed a second element without departing from the teachings of the present embodiments.

Unless otherwise defined, all terms (including technical and scientific terms) used herein have the same meaning as commonly understood by one of ordinary skill in the art to which these embodiments belong. It will be further understood that terms, such as those defined in commonly-used dictionaries, should be interpreted as having a meaning that is consistent with their meaning in the context of the relevant art and will not be interpreted in an idealized or overly-formal sense unless expressly so defined herein.

Many different embodiments have been disclosed herein, in connection with the above description and the drawings. It will be understood that it would be unduly repetitious and obfuscating to literally describe and illustrate every combination and subcombination of these embodiments. Accordingly, the present specification, including the drawings, shall be construed to constitute a complete written description of all combinations and subcombinations of the embodiments described herein, and of the manner and process of making and using them, and shall support claims to any such combination or subcombination.

In the drawings and specification, there have been disclosed various embodiments and, although specific terms are employed, they are used in a generic and descriptive sense only and not for purposes of limitation.

What is claimed is:

1. A wireless electronic device comprising:

a Substrate Integrated Waveguide (SIW);

a first metal layer on a first side of the SIW, the first metal layer comprising one or more top wave traps, each directly connected to the first metal layer and extending outward along a major plane of a first side of the first metal layer;

a second metal layer on a second side of the SIW, opposite the first side of the SIW;

a feeding structure extending through the first metal layer and into the SIW; and a reflector on the first side of the SIW, the reflector directly connected to the first metal layer and extending outward along a major plane of the first side of the first metal layer, wherein the wireless electronic device is configured to resonate at a resonant frequency when excited by a signal transmitted or received through the feeding structure, and wherein the one or more top wave traps are configured to shape a signal radiated by the reflector based on the signal transmitted or received through the feeding structure.

2. The wireless electronic device of claim 1, wherein the second metal layer comprises one or more bottom wave traps each directly connected to the second metal layer and extending outward along a major plane of a first side of the second metal layer, and wherein the one or more bottom wave traps are vertically aligned with respective ones of the top wave traps.

3. The wireless electronic device of claim 1, wherein the feeding structure comprises:

a feed via;

a ring structure spaced apart from and surrounding the feed via; and an insulator between the ring structure and the feed via.

4. The wireless electronic device of claim 3, wherein a radius of the ring structure and/or a width of the ring structure are, configured to impedance match a signal feeding element that is electrically coupled to the feeding structure.

5. The wireless electronic device of claim 1, wherein the feeding structure extends from the first metal layer through the SIW to the second metal layer.

6. The wireless electronic device of claim 1, wherein the one or more top wave traps comprise:

a first top wave trap on a first side of the feeding structure, and a second top wave trap on a second side of the feeding structure that is opposite the first side of the feeding structure.

7. The wireless electronic device of claim 6, wherein the first top wave trap and the second top wave trap are equally distant from the feeding structure.

8. The wireless electronic device of claim 6, wherein the first top wave trap, the second top wave trap and the reflector are approximately parallel to one another along a major plane of the first side of the SIW, and wherein the reflector is spaced apart from and/or equally distant from the first top wave trap and the second top wave trap.

9. The wireless electronic device of claim 8, wherein the first top wave trap and the second top wave trap are directly connected to the first metal layer and do not overlap the SIW.

10. The wireless electronic device of claim 1, wherein the first metal layer comprises a plurality of top via holes spaced apart along the first metal layer overlapping the SIW, wherein the second metal layer comprises a plurality of bottom via holes that are approximately vertically aligned with respective ones of the plurality of top via holes, and wherein the feeding structure is between at least two of the plurality of top via holes in the first metal layer.

11. The wireless electronic device of claim 1, wherein a first top wave trap of the one or more top wave traps comprises a notch in the first metal layer, and wherein a first portion of the first top wave trap on one side of the notch is parallel to and spaced apart from a second portion of the first top wave trap on another side of the notch.

12. The wireless electronic device of claim 11, wherein the first top wave trap and the second top wave trap are equally distant from the feeding structure, and wherein the first portion of the first top wave trap and the second portion of the first top wave trap extend equally distant away from the SIW.

13. The wireless electronic device of claim 11, wherein a length of the first portion of the first top wave trap extending away from the SIW is between 0.25 effective wavelengths and 0.5 effective wavelengths of the resonant frequency, and wherein a length of the second portion of the first top wave trap extending away from the SIW is between 0.25 effective wavelengths and 0.5 effective wavelengths of the resonant frequency.

14. The wireless electronic device of claim 1, wherein a length of the reflector extending away from the SIW is between 0.25 effective wavelengths and 0.5 effective wavelengths of the resonant frequency.

15. The wireless electronic device of claim 2, the wireless electronic device further comprising:

one or more additional SIWs;

one or more additional feeding structures extending through the first metal layer, wherein the one or more additional feeding structures are associated with respective ones of the additional SIWs; and one or more additional reflectors on the first side or the second side of the SIW, wherein the one or more additional reflectors are associated with respective ones of the additional SIWs and extend outward along a major plane of the first side of the first metal layer or along a major plane of a first side of the second metal layer.

16. The wireless electronic device of claim 15, wherein one of the additional reflectors associated with one of the additional SIWs that is adjacent to the SIW is on the second metal layer and extends outward along a major plane of a first side of the second metal layer.

17. A wireless electronic device comprising:

a plurality of Substrate Integrated Waveguides (SIWs) spaced apart of one another and arranged in a plane;

a first metal layer on a first side of the SIWs, the first metal layer comprising a plurality of top wave traps, wherein the plurality of top wave traps each are directly connected to the first metal layer and extend outward along a major plane of a first side of the first metal layer;

a second metal layer on a second side of the SIWs, opposite the first side of the SIWs, the second metal layer comprising a plurality of bottom wave traps, wherein the plurality of bottom wave traps each are directly connected to the second metal layer and extend outward along a major plane of a first side of the second metal layer;

a plurality of feeding structures associated with respective ones of the SIWs, the plurality of feeding structures extending through the first metal layer and into the associated SIW; and a plurality of reflectors directly connected to and extending outward along the major plane of either the first metal layer or the second metal layer, wherein respective ones of the plurality of reflectors are associated with respective ones of the SIW, wherein a first reflector of the plurality of reflectors is associated with a first SIW of the plurality of the SIWs and extends outward along the first side of the first metal layer, wherein a second reflector of the plurality of reflectors is associated with a second SIW of the plurality of SIWs that is adjacent the first SIW, and extends outward along the first side of the second metal layer, wherein the wireless electronic device is configured to resonate at a resonant frequency when excited by a signal transmitted or received through at least one of the feeding structures, and wherein a first top wave trap and a second top wave trap of the plurality of top wave traps are each adjacent the first reflector and are configured to trap a signal radiated by the reflector based on the signal transmitted or received through the at least one of the feeding structures.

18. The wireless electronic device of claim 17, wherein the first reflector is approximately parallel to the first top wave trap and the second top wave trap, wherein the first reflector extends between the first top wave trap and the second top wave trap, wherein the second reflector is approximately parallel to a first bottom wave trap and a second bottom wave trap of the plurality of bottom wave traps, and wherein the second reflector extends between the first bottom wave trap and the second bottom wave trap.

19. The wireless electronic device of claim 18, wherein the second top wave trap vertically aligns with the first bottom wave trap, wherein the plurality of top wave traps further comprises a third top wave trap that vertically aligns with the second bottom wave trap, and wherein the plurality of bottom wave traps further comprises a third bottom wave trap that vertically aligns with the first top wave trap.

20. The wireless electronic device of claim 17, wherein the wireless electronic device further comprises:

a first subarray comprising a first plurality of the SIWs; and a second subarray comprising a second plurality of the SIW.

21. The wireless electronic device of claim 20, wherein the first subarray and/or the second subarray are configured to transmit multiple-input and multiple-output (MIMO) communication and/or diversity communication.

* * * * *